US005274968A

United States Patent [19]

Pardo

[11] Patent Number: 5,274,968

[45] Date of Patent: Jan. 4, 1994

[54] BUILDING BLOCK FOR USE WITH FLASHING AND ARRANGEMENT FOR WEEPING CONDENSATION

[76] Inventor: Jorge Pardo, 11501 Drop Forge La., Reston, Va. 22091

[21] Appl. No.: 881,601

[22] Filed: May 15, 1992

[51] Int. Cl.[5] ..... E04C 1/39

[52] U.S. Cl. ..... 52/97; 52/302.3; 52/302.4; 52/310; 52/503; 52/504; 52/505; 52/607

[58] Field of Search ..... 52/58, 59, 97, 198, 52/303, 310, 504, 209, 302, 503, 505, 169.5, 607

[56] References Cited

U.S. PATENT DOCUMENTS

| | | | |
|---|---|---|---|
| 2,261,510 | 11/1941 | Atcheson | 52/97 |
| 2,657,570 | 11/1953 | Moore | 52/303 |
| 3,429,084 | 2/1969 | Brewer | 52/303 |
| 4,486,986 | 12/1984 | Cosenza | 52/169.5 |

*Primary Examiner*—Carl D. Friedman
*Assistant Examiner*—Matthew E. Leno
*Attorney, Agent, or Firm*—Lane, Aitken & McCann

[57] ABSTRACT

A construction unit includes weep openings through a front wall, side walls, and a center web, and at least one slot extending parallel to a rear wall to receive a flashing member, the slot being defined at least partially by the rear wall. An insert member having an insect screen is positioned in each of the weep openings of the front wall.

25 Claims, 5 Drawing Sheets

BUILDING BLOCK FOR USE WITH FLASHING AND ARRANGEMENT FOR WEEPING CONDENSATION

BACKGROUND OF THE INVENTION

The present invention relates to construction units, or blocks, and, more particularly to construction units having provision for directing condensation from the interior of the units to the exterior.

Most walls used in constructing buildings have vertical cavities in which condensation forms as a result of changes in temperature. This is true in walls constructed of conventional blocks of concrete or other materials which have hollow vertical cores extending through the blocks. In concrete block walls in which no provision is made for allowing the condensation to escape, the condensation builds up in pools at the bottom of the wall and gradually seeps through the concrete blocks at the bottom. This seepage through the material of the blocks results in stains on the exterior of the blocks caused by efflorescence. In efflorescence, the water seeping through the material of the blocks dissolves certain chemicals in the material and carries them to the surface of the block, where they cause stains.

A common method of allowing condensation to escape is to provide weep openings in a wall made of blocks by leaving out a portion of the mortar near the bottom of vertical joints between the blocks. Such an arrangement is not very effective because the openings in the mortar communicate with the joints between adjacent blocks, whereas most of the problem with condensation and other moisture in the blocks arises in the hollow cores, which are not in direct communication with the joints between adjacent blocks.

In an another known arrangement for allowing condensation to weep from the interior of a concrete block wall to the exterior, the bottom course of the wall is formed with a double course of blocks each having a depth approximately equal to one-half of the depth of the other courses of blocks. Flashing having a vertical section extending between upper and lower horizontal sections is positioned in the double course of blocks, with the upper horizontal section of the flashing extending over the top of the inner course of the double course, the vertical section extending between the inner and outer courses, and the lower horizontal section extending under the outer course. In addition, tubes or wicks are positioned above the lower horizontal section of the flashing and under the outer course to conduct the condensation from the interior of the wall to the exterior. This construction has the disadvantage that extra units must be assembled in the bottom course and the tubes or other devices must be inserted for proper drainage of the condensate. In actual construction conditions, workers often fail to install the tubes or other devices.

Although the present application specifically mentions condensation as the source of moisture in the wall, the moisture can be from other sources, such as the infiltration of rain into the wall through cracks, or leakage into the wall from other sources, or still other causes.

SUMMARY OF THE INVENTION

By the present invention, a building unit is provided which defines openings in a front wall for allowing condensation to weep from the interior of the unit to the exterior, and also provides at least one slot extending generally parallel to a rear wall of the block and at the rear wall to accommodate flashing. The slot is at least partially defined by the rear wall, so that flashing can extend from the slot, across the entire hollow cores of the block to the front wall containing the weep openings. Thus, condensation can be directed from the interior of a building wall employing the units to the exterior without prolonged contact of the condensate with any material which could result in efflorescence. The units according to the present invention can also be employed in an inverted orientation so that the weep openings function as vents for a wall of a building.

The construction units according to the present invention can have the same overall size and shape as conventional concrete blocks, and they are configured so that they can be produced in standard concrete block machines at the normal high speed rate of production, that is, with a block being produced in each mold cavity every six to seven seconds. The weep openings and the slot are formed by elements projecting down into the mold f rom the top as the units are molded in an inverted orientation and removed through the bottom of the mold.

In a first embodiment of the construction unit according to the present invention, there are a plurality of aligned slots, one slot extending through each of the side walls of the unit and another slot extending through a web of the unit. A recess is defined in the interior surface of the rear wall of the unit from one side of the unit to the other, and the rear portions of the aligned slots are defined by the recessed portion of the rear wall. An upper edge of the flashing is positioned in the recess, so that condensation trickling down the interior surface of the rear wall will go onto the forward side of the flashing.

In another embodiment of the construction unit according to the present invention, the rear wall of the unit is thickened and an elongate slot extends, spaced behind the cores, along the bottom of the rear wall of the unit. Flashing is received in the elongate slot, entirely behind the cores, so that there is no possibility that condensate can drip or trickle between the flashing and the rear wall.

In still another embodiment of the construction unit according to the present invention, a secondary cavity is defined between the cores and the rear wall, the secondary cavity being separated from the cores by an intermediate wall parallel to and spaced from the rear wall. Slots for receiving the flashing extend through the side walls, between the secondary cavity and the exterior of the unit.

In all of the embodiments of the present invention, additional weep openings can be provided through the side walls and the web of the construction unit to place the hollow cores of the unit in fluid communication with one another and with the spaces between adjacent units.

In addition, in all embodiments, a slot through the rear wall of the unit can be provided, either just to the left or just to the right of the center web, to accommodate flashing from an adjacent unit oriented at 90°, such as in a corner of a wall containing the units according to the present invention. Whether a unit containing a rear slot to the left of the web or to the right of the web is employed depends on whether such a unit is used in a corner at the left end of a wall or at the right end of a wall. In units having a rear slot to the left of the web, the principal flashing slot of the unit does not extend through the left wall of the unit. Similarly, in units having a rear slot to the right of the web, the principal flashing slot does not extend through the right side wall of the unit.

An insert containing an insect screen is positioned in each of the weep openings to prevent insects from entering the construction units to build nests or lay eggs.

BRIEF DESCRIPTION OF THE DRAWING FIGURES

DETAILED DESCRIPTION OF THE PREFERRED EMBODIMENTS

Figure 1:
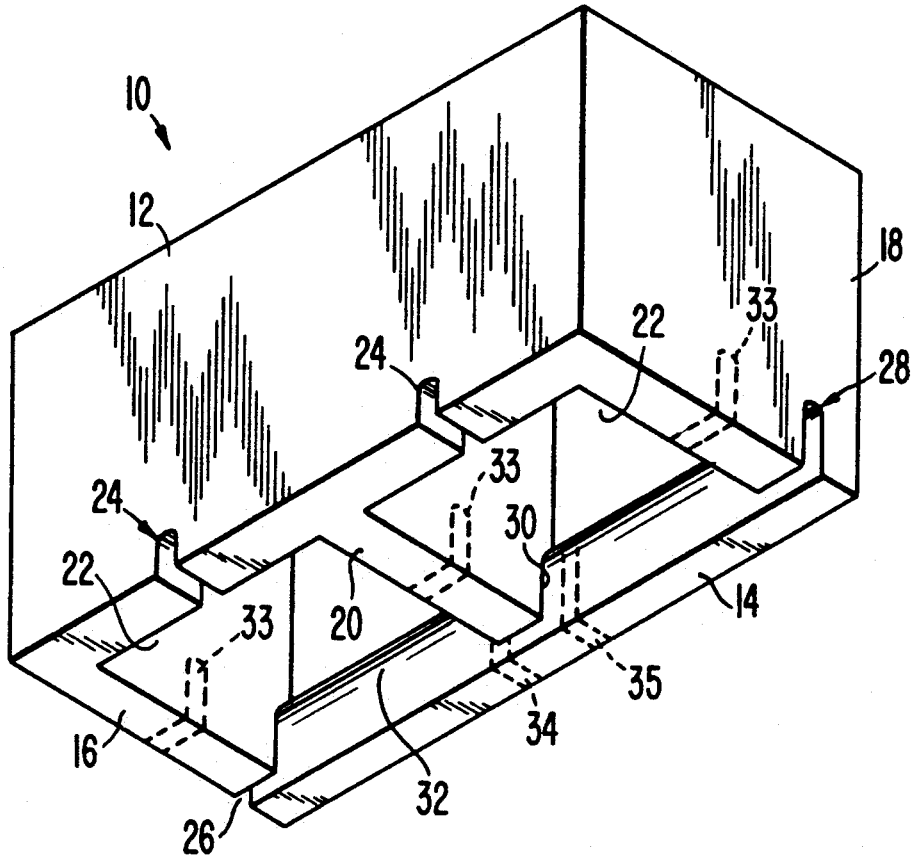
FIG. 1 is a perspective view of the construction unit according to the present invention.

As can be seen from FIG. 1, the construction unit according to the present invention, which is designated generally by the reference numeral 10, has a generally rectangular parallellepiped shape similar to that of a conventional concrete block. More specifically, the construction unit 10 has walls which will be designated for ease of description as a front wall 12, a rear wall 14, side walls 16 and 18, and a center wall, or web, 20. Two cores, or cavities, 22 are defined in the construction unit 10 extending all the way through the unit 10 from a top to a bottom. Two openings 24 in the shape of slots are defined in the front wall 12, each opening 24 having an open side at the bottom surface of the construction unit 10, each slot 24 extending through the front wall 12 to a respective one of the cores 22. Slots 26, 28 and 30 are defined in the walls 16, 18, and 20, respectively, at the junctures of those walls with the rear wall 14. The slots 26, 28 and 30 extend into the rear wall 14 so that a rear side and a portion of a closed end of each of the slots is defined by the rear wall 14. A recess or indentation 32 of constant cross-section extends along the bottom of the rear wall 14, the indentation being congruent to and in alignment with the rear side and closed end portions of the notches 26, 28 and 30 which are defined by the rear wall 14.

The construction unit 10 can have the same overall size and shape as a standard concrete block, or can have a different size and shape. All of the indentations into the construction unit 10, specifically, the openings 24 and the slots 26, 28 and 30 all face the bottom of the block and, accordingly, the units 10 can be produced in a conventional concrete block mold machine at a standard high rate of speed, a unit 10 being produced from each mold cavity of a machine every six to seven seconds. The block can be made of concrete or other material. Although the openings 24 and the slots 26, 28 and 30 are all illustrated as having parallel sides and an arcuate closed end, other configurations are possible. In order that the units 10 can be produced in the above manner, the openings 24 and the slots 26–30 all face upward in the mold cavity, so that an element associated with the mold can project down into the mold to form the openings and slots. It is important that the openings and slots have shapes which allow concrete to flow down and around the downward projecting element defining the openings and slots during molding. The shape illustrated, in which there are parallel sides and an arcuate closed end, is one such shape.

Additional weep openings 33, which are shown in dashed lines in FIG. 1, can be provided through the end walls 16 and 18 to place the hollow cores 22 in fluid communication with the joints between adjacent units 10, so that moisture in the joints can weep into the cores and then out of the cores through the weep holes 24. The weep openings 33 extend generally normal to the side walls 16, 18. Another weep opening 33 can be formed in the web 20 to place the two cores 22 of the unit 10 in fluid communication with one another for venting and transfer of moisture.

Modified units 10 can be produced for forming a corner in a wall while providing accommodation for flashing members at the corner. In order to achieve this, a slot 34 or 35 is formed in the rear wall 14 as can be seen in FIG. 1, the slot having the same size and shape as the slots 26, 28 and 30. The center wall, or web, 20 has opposite vertical sides, and when one of the slots 34, 35 is present, it has a side which is substantially coplanar with one of the sides of the web 20. The other side of the slot 34 or 35 is spaced laterally from the plane containing the respective side of the web 20 and the first side of the slot 34 or 35.

A construction unit 10 for use in a corner at the left end of a wall, with respect to the directions of FIG. 1, is formed with the slot 34 in the rear wall 14. At such a corner, a side wall 18 of a construction unit 10 (not shown) oriented at 90° with respect to the unit 10 shown in FIG. 1 abuts the portion of the rear wall 14 bordering the left core 22. The slot 28 of the construction unit 10 oriented at a right angle with respect to the construction unit 10 of FIG. 1 aligns with the slot 34 so that a flashing member in the slot of the construction unit 10 oriented at a right angle can extend into the construction unit 10 of FIG. 1 through the slot 34. A construction unit 10 used in a corner at the left end of a wall omits the slot 26 through the side wall 16.

Similarly, a modified form of the construction unit 10 for use in a corner at the right end of a wall, with reference to FIG. 1, includes the slot 35 through the rear wall 14. The slot 35 aligns with the slot 26 of a construction unit 10 oriented at a right angle with respect to the construction unit 10 shown in FIG. 1 and placed in abutment with the portion of the rear wall 14 bordering the right core 22. In this case, the slot 28 through the side wall 18 is omitted from the construction unit 10 of FIG. 1.

Figure 2:
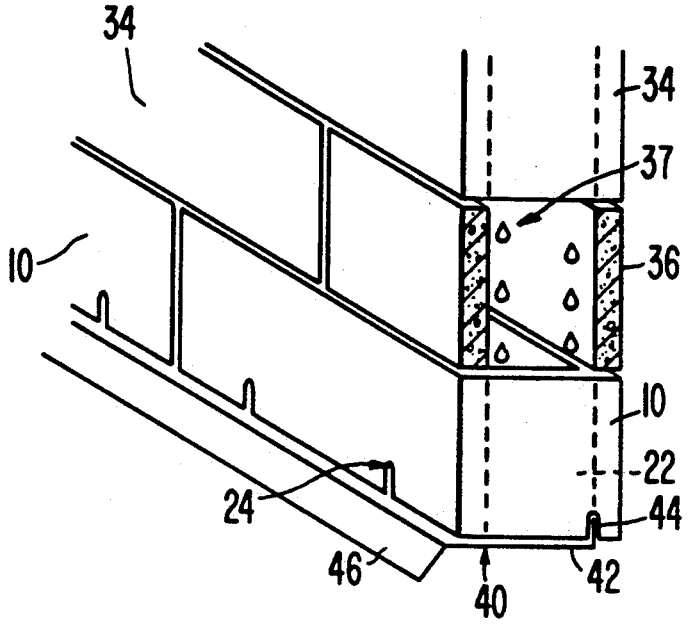
FIG. 2 is a perspective view of units like that of FIG. 1 in place in a bottom course of a wall constructed of hollow units, with flashing being inserted in the units according to the present invention.

As can be seen from FIG. 2, a plurality of construction units 10 according to the present invention is assembled in a wall with conventional building blocks 36. The construction units 10 are placed in a course at a level where it is desired to direct condensation out of the wall. The condensation, which is represented by the drops 37, forms in the cavity of the wall defined by the hollow cores of the building blocks 36, as well as by the cores 22 of the one course containing the construction units 10 according to the present invention. The condensation forms as the result of the presence of air in the cavities and changes in temperature.

A preformed flashing member 40 is placed under the course of the units 10. Ordinarily, a single flashing member 40 extends over a plurality of the construction units 10. The flashing member 40 includes a main, horizontal portion 42, an interior, vertical flange 44, and an exterior, angled drip portion 46. The main portion 42 underlies most of each construction unit 10 and all of the cores 22 defined by the construction unit 10. As a result, the flashing member 40 prevents condensation from traveling any farther down in the wall defined by the building blocks 34 and the units 10. The interior flange 44 is received in the aligned notches 26, 28 and 30 and thereby functions as a positioning mechanism as well as a securing mechanism. Furthermore, since the rear portions of the notches 26, 28 and 30 extend into the recess 32 of the rear wall 14, the interior vertical flange 44 is positioned in the recess, substantially flush with or behind the portion of the rear wall 14 which is not indented. Therefore, the likelihood of any condensation traveling behind the flashing member 40 is minimized. Condensation collects on the main portion 42 of the flashing and flows out through the weep openings 24 of the units 10 before it can accumulate to any great extent on the flashing member 40. As the condensation leaves the weep openings 24, it travels down the angled drip portion 46 which directs the flashing beyond the exterior surface of lower portions of the wall so that the condensation does not drip on the wall.

Figure 3:
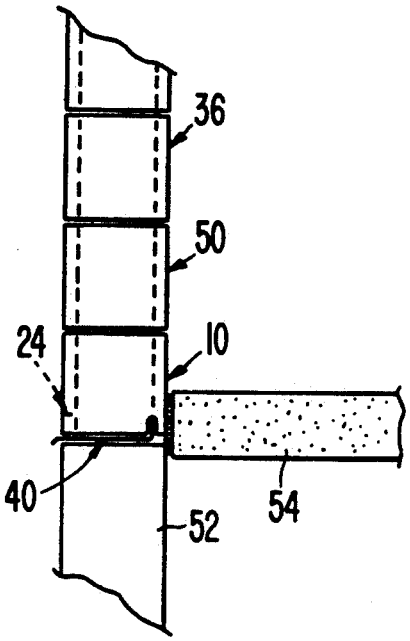
FIG. 3 is a schematic view of construction units like the unit of FIG. 1 and pre-formed flashing being employed at a foundation.

FIG. 3 illustrates the use of the construction units 10 according to the present invention in a wall 50 at a foundation 52. A floor 54 is positioned at the level of the top of the foundation 52, where the course of construction units 10 is also positioned. The flashing member 40 extends across the top of the foundation 52, between the foundation and the construction units 10.

Figure 4:
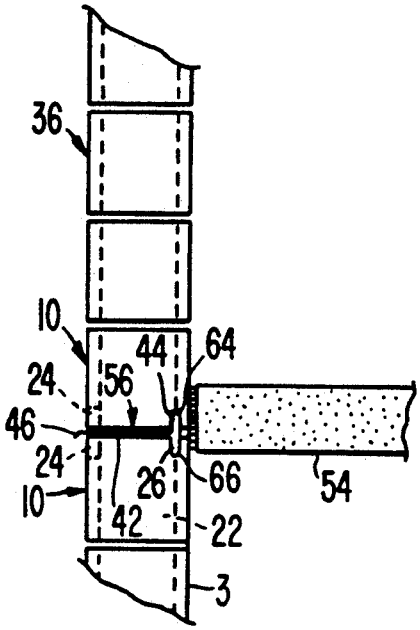
FIG. 4 is a schematic view of construction units like the unit of FIG. 1 and preformed flashing being employed at a guide course.

The construction shown in FIG. 4 is similar to that illustrated in FIG. 3, but the foundation 52 is replaced by a structure 55, such as a foundation of concrete blocks 34, topped by a guide course of the units 10 in an inverted orientation in which all of the openings 24 and the slots 26, 28 and 30 are at the top. In this orientation, the aligned slots 26, 28 and 30 face upward and serve as guides to receive a flashing member 56. The flashing member 56 has a main, horizontal portion 42, an interior, vertical flange portion 44, and an exterior, angled drip portion 46, like the flashing member 40. The flashing member 56 further has a connecting portion 58 and a reverse flange portion 60 both integral with the flange portion 44. The connecting portion 58 is perpendicular to the flange portion 44, and the reverse flange portion 60 extends from the connection portion 58, parallel to and spaced from the flange portion 44 to beyond the horizontal main portion 42. Thus, the reverse flange portion 60 projects transverse to the horizontal main portion 42 in a direction opposite to the direction of projection of the flange portion 44. The reverse flange portion 60 is received in the upward facing aligned slots 26, 28 and 30 in the inverted units 10 to hold the flashing member 56 in position while the upper course of units 10 is laid. The flange portion 44 and a portion of the reverse flange portion 60 are received in the downward facing slots 26, 28 and 30 of the upper course of units 10. The notches 24 also serve as openings to the exterior of the structure to vent a cavity defined by the hollow cores 22 of the units 10 and the cores of the concrete blocks 36.

Figure 5:
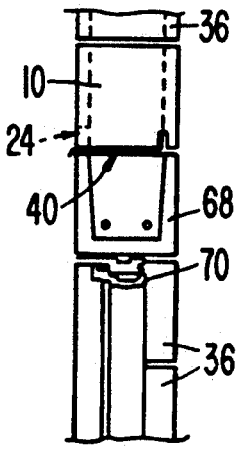
FIG. 5 is a schematic view of construction units like the unit of FIG. 1 and performed flashing being used at a lintel.

FIG. 5 illustrates a construction in which the units according to the present invention are used in a course just above a lintel 68 at the top of an opening in a wall, such as at a door or window 70. In this arrangement, the units 10 according to the present invention are oriented with the notches 24–30 at the bottom, and a flashing member 40 is in place under the units 10.

Figure 6:
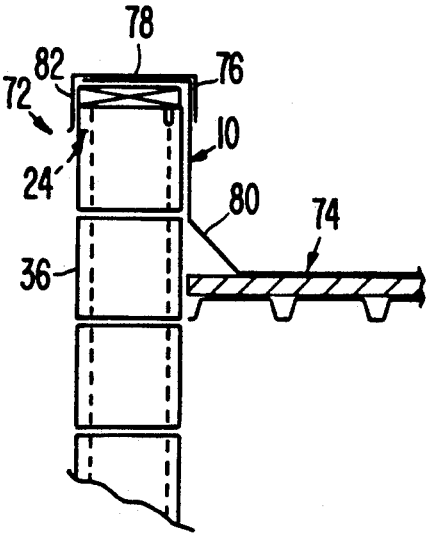
FIG. 6 is a schematic view of construction units like the unit of FIG. 1 being employed at a parapet.

In FIG. 6, an arrangement is illustrated in which the units 10 are used in a top course of a parapet 72. The units 10 are inverted so that the notches 24–30 define vent openings. The parapet 72 extends above a roof 74 and includes a cap member 76 extending along the tops of the units 10, with coping members 78 and 80 being added. The coping member 78 has a depending portion 82 which overlies the openings 24 to prevent, for example, wind-driven rain from entering, while allowing air to enter.

Figure 7:
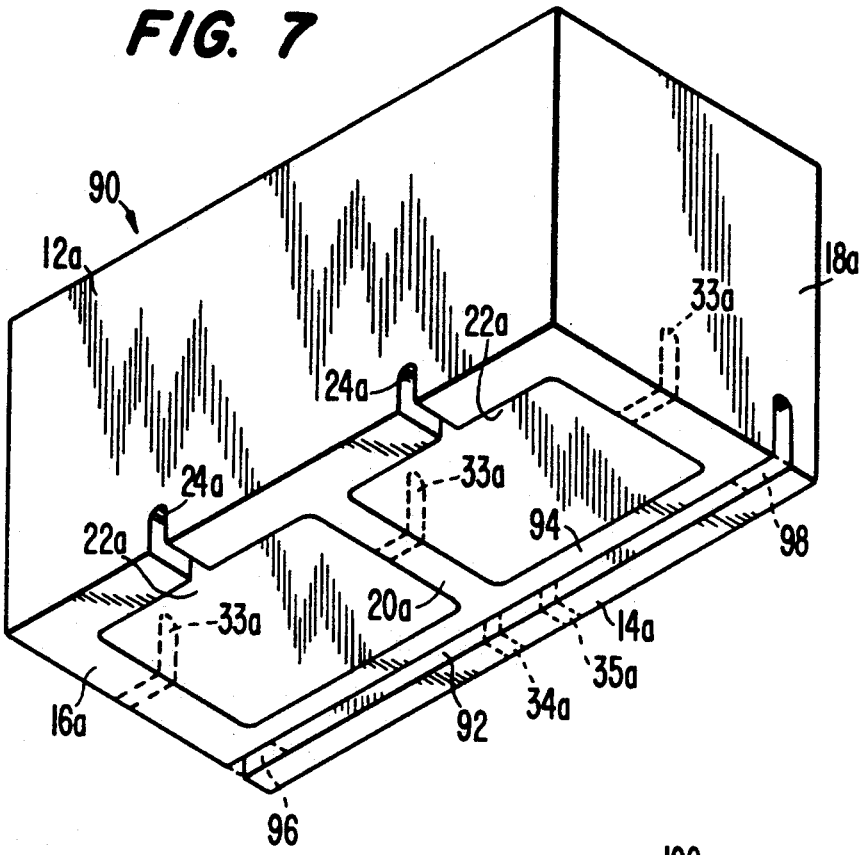
FIG. 7 is a perspective view of another embodiment of the construction unit according to the present invention.

In accordance with another embodiment according to the present invention, as can be seen from FIG. 7, a construction unit 90 includes a front wall 12*a*, a rear wall 14*a*, side walls 16*a* and 18*a*, and a center wall, or web, 20*a*. Two cores 22*a* have a smaller front to rear dimension than the cores 22 of the construction unit 10 of FIG. 1, for the same size unit. Two slot-shaped weep openings 24*a* are defined in the front wall 12*a*. The rear wall 14*a* is thicker than the rear wall 14 of the unit 10, and an elongate slot, defined entirely within the rear wall 14*a*, extends along the entire width of the rear wall 14*a* from one side wall 16*a* to the opposite side wall 18*a*. In cross-section, the slot 92 has parallel sides and an arcuate closed end. As with the openings 24 and slots 26–30 of FIG. 1, other shapes for the openings 24*a* and the elongate slot 92 are acceptable which allow concrete to flow down and around the downward projecting elements of the mold during the molding of the unit. Similar to the weep openings 33 in the construction unit 10 shown in FIG. 1, weep holes 33*a* can be formed in the side walls 16*a* and 18*a* and the web 20*a* of the construction unit 90.

The elongate slot 92 receives a flashing member and, more specifically, receives the interior, vertical flange 44 of the flashing member 40. From a line along which the interior flange 44 is received, the flashing member extends forward from the elongate slot 92, past an interior portion 94 of the rear wall 14*a*, the cores 22*a* and the front wall 12*a*. Since the elongate groove 92 is entirely rearward of the cores 22*a*, being separated from the cores 22*a* by the interior portion 94 of the rear wall 14*a*, condensate is positively precluded from trickling down the rear side of the cores 22*a* and behind the flashing. Thus, all of the condensate from the cores is directed for disposal through the weep openings 24*a*.

As with the construction units 10 of the embodiment of FIG. 1, modified units 90 can be produced for forming a corner in a wall while providing accommodation for flashing members at the corner. The center wall, or web, 20a has opposite vertical sides, and when one of the slots 34a, 35a is present, it has a side which is substantially coplanar with one of the sides of the web 20a. The other side of the slot 34a or 35a is spaced laterally from the plane containing the respective side of the web 20a and the first side of the slot 34a or 35a. A construction unit 90 for use in a corner at the left end of a wall, with respect to the directions of FIG. 7, is formed with the slot 34a in the rear wall 14a. At such a corner, a side wall 18a of a construction unit 90 (not shown) oriented at 90° with respect to the unit 90 shown in FIG. 7 abut; the portion of the rear wall 14a adjacent to the left core 22a. The slot 92 of the construction unit 90 oriented at a right angle with respect to the construction unit 90 of FIG. 7 aligns with the slot 34a so that a flashing member in the slot of the construction unit 90 oriented at a right angle can extend into the construction unit 90 of FIG. 7 through the slot 34a. The slot 92 of a construction unit 90 used in a corner at the left end of a wall terminates short of the side wall 16a, as indicated by the dashed lines at 96.

Similarly, a modified form of the construction unit 90 for use in a corner at the right end of a wall, with reference to FIG. 7, includes the slot 35a through the rear wall 14a just to the right of the center wall 20a. The slot 35a aligns with the slot 92 of a construction unit 90 oriented at a right angle with respect to the construction unit 90 shown in FIG. 7 and placed in abutment with the portion of the rear wall 14a adjacent to the right core 22a. In this case, the slot 92 terminates short of the side wall 18a as indicated at 98 by the dashed lines.

Figure 8:
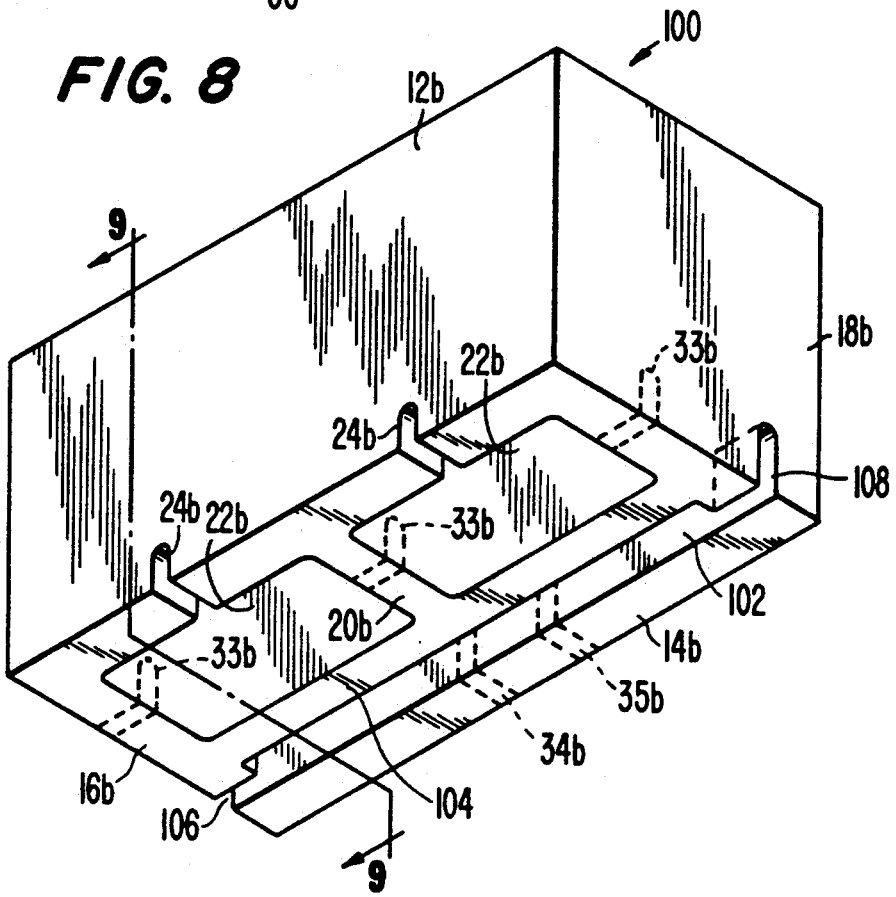
FIG. 8 is a perspective view of still another embodiment of the construction unit according to the present invention.
Figure 9:
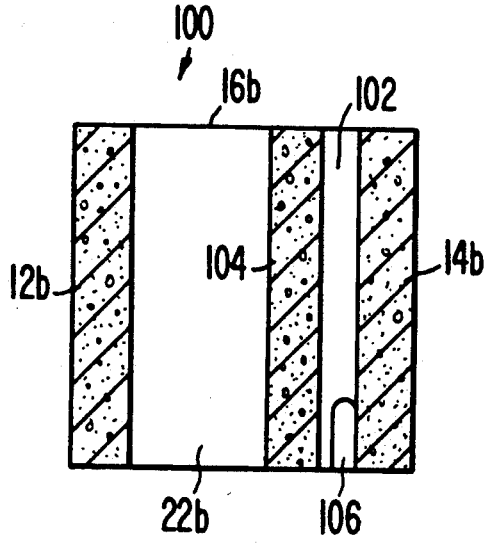
FIG. 9 is a cross-section taken along the line 9—9 of FIG. 8.
Figure 10:
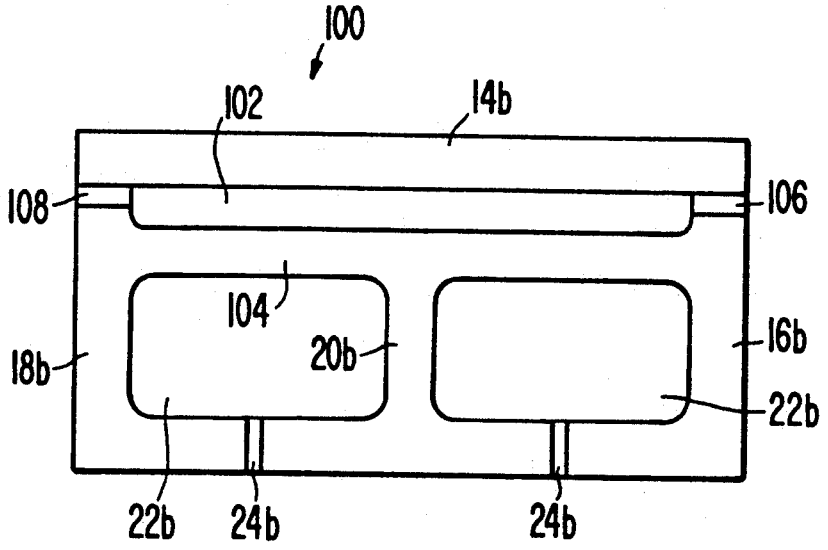
FIG. 10 is a bottom view of the construction unit of FIG. 8.

In still another embodiment of the construction unit according to the present invention, which is designated generally in FIGS. 8 and 9 by the reference numeral 100, the unit includes a front wall 12b, a rear wall 14b, side walls 16b and 18b and a center wall, or web, 20b. Two cores 22b extend through the unit 100 from a top to a bottom, and two weep openings 24b in the shape of slots are defined in the front wall 12b. Similar to the weep openings 33 and 33a of the construction units 10 and 90, respectively, weep openings 33b can be formed in the side walls 16b and 18b and the web 20b of the construction unit 100.

The construction unit 100 also includes a secondary cavity 102 defined in the unit 100 behind the cores 22b and forward of the rear wall 14b. An intermediate wall 104 separates the secondary cavity 102 from the cores 22b and extends between the side walls 16b and 18b from the top to the bottom of the unit 100. Slots 106 and 108 are defined in the side walls 16b and 18b, respectively. The slots 106 and 108 can have the same shapes as the slots 26 and 28 of the construction unit 10 illustrated in FIG. 1 and are located at the junctures of the side walls with the rear wall 114b. There is no need to provide a recess along the lower portion of the rear wall 14b, since there is no need for flashing extending into the slots 106 and 108 to be positioned behind the interior surface of the rear wall 14b. This is due to the fact that there is unlikely to be condensation in the secondary cavity 102, the condensation occurring in the cores 22b which lie on an exterior side of the secondary cavity 102.

Since the flashing, such as the interior, vertical flange 44 of the flashing member 40, is received in the slots 106 and 108, it extends behind the cores 22b, in which the condensate forms. Therefore, there is no possibility of the condensate falling or dripping behind the flashing and, thus, all of the condensate is directed forward for disposal through the weep openings 24b. Due to the presence of the second cavity 102, the unit 100 is lighter in weight than a unit 90 of the same exterior dimensions, and the secondary cavity provides greater thermal insulation. Furthermore, since the web 20b terminates at the intermediate wall 104, rather than the rear wall 14b, the web 20b does not conduct heat from the rear wall 14b of the unit 100 through the front wall 12b, to the outside. Accordingly, the secondary cavity 102 provides an additional thermal break.

Modified units 100 can be produced for forming a corner in a wall while providing accommodation for flashing members at the corner. In order to achieve this, a slot 34b or 35b is formed in the rear wall 14b as can be seen in FIG. 8, the slot 34b or 35b having the same size and shape as the slots 106 and 108. The center wall, or web, 20b has opposite vertical sides, and, when one of the slots 34b, 35b is present, the slot has a side which is substantially coplanar with one of the sides of the web 20b. The other side of the slot 34b or 35b is spaced laterally from the plane containing the respective side of the web 20b and the first side of the slot 34b or 35b. A construction unit 100 for use in a corner at the left end of a wall, with respect to the directions of FIG. 8, is formed with the slot 34b in the rear wall 14b, just to the left of the center wall 20b. At such a corner, a side wall 18b of a construction unit 100 (not shown) oriented at 90° with respect to the unit 100 shown in FIG. 8 abuts the portion of the rear wall 14b adjacent to the left core 22b. The slot 108 of the construction unit 100 oriented at a right angle with respect to the construction unit 100 of FIG. 8 aligns with the slot 34b so that a flashing member in the slot 108 of the construction unit 100 oriented at a right angle can extend into the construction unit 100 of FIG. 8 through the slot 34b. A construction unit 100 used in a corner at the left end of a wall omits the slot 106 through the side wall 16b.

Similarly, a modified form of the construction unit 100 for use in a corner at the right end of a wall, with reference to FIG. 8, includes the slot 35b through the rear wall 14b just to the right of the center wall 20b. The slot 35b aligns with the slot 106 of a construction unit 100 oriented at a right angle with respect to the construction unit 100 shown in FIG. 8 and placed in abutment with the portion of the rear wall 14b adjacent to the right core 22b. In this case, the slot 108 through the side wall 18b is omitted from the construction unit 100 of FIG. 8.

The units 90 and 100 can be produced in a standard concrete block machine as the units 10 can, with the weep openings and slots defined by members associated with the mold depending into the mold. Furthermore, the units 90 and 100 can be employed in structures in the same manner as the units 10, such as in the structures illustrated in FIGS. 2–6.

Figure 11:
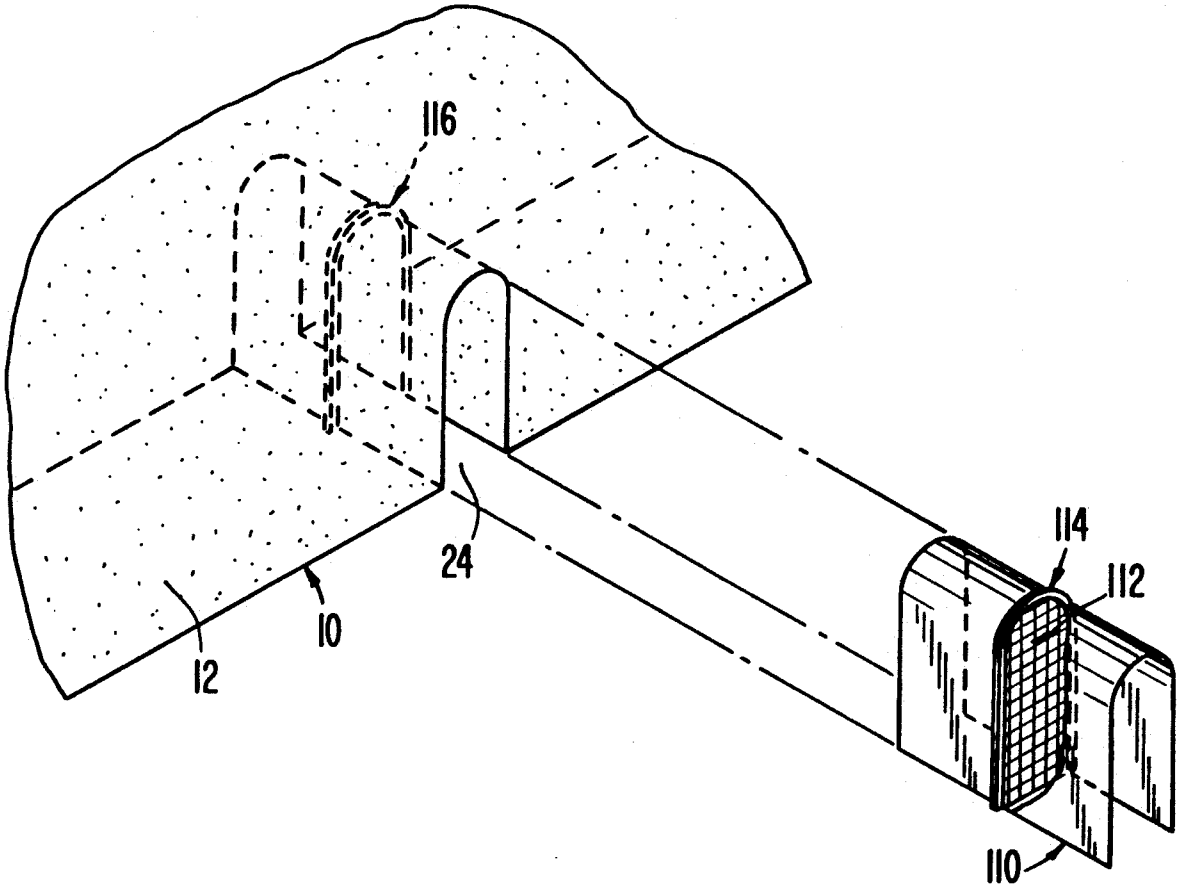
FIG. 11 is an exploded perspective view showing an insert containing an insect screen removed from a weep opening.

As can be seen from FIG. 11, an elongate insert member 110 having a U-shape in cross section has a recessed insect screen 112 secured to its interior midway between open ends. A raised retention lip 114 of U-shape protrudes outwardly from the exterior surface of the insert member 110 in the plane defined by the insect screen 112. The insert member 110 has a length substantially equal to the thickness of the walls, for example, the front wall 12, of the construction unit 10, and, thus, substantially equal to the length of the weep opening 24.

In the material of the wall 12 defining the weep opening 24, a U-shaped groove 116 is formed midway along the length of the groove. The groove 116 has a size and shape conforming to the size and shape of the raised retention lip 114 on the insert member 110. The groove 116 is formed during the molding of the construction unit 10. A groove 116 is formed in each of the weep openings 24 and, if desired, in the weep openings 33.

The exterior surface of the insert member 110 conforms to the material of the construction unit 10 defining the weep opening 24 and the raised retention lip 114 fits into the groove 116 to prevent the insert member 110 from shifting longitudinally in the weep opening. The insert member 110 is made of a plastic or metal and is pressure fit or adhered in the weep opening 24. Insertion is done at the factory so that problem of construction workers failing to install the insert members at the job site is not encountered. An insert member 110 is positioned in each of the weep openings 24, as well as any weep openings 33 which might be exposed at, for example, a corner of a wall. In addition, although the insert members 110 have been described in connection with the construction unit 10, it is understood that the insert members 110 are employed in the weep openings of each of the embodiments of the construction unit according to the present invention.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. A construction unit for use with flashing to direct water out of a structure, comprising:
- a front wall, a rear wall, and two side walls;
- a top surface and a bottom surface;
- at least one hollow core extending from said top surface to said bottom surface;
- an opening extending through said front wall from said hollow core to the exterior of the construction unit; and
- a first slot adapted to receive flashing, said first slot extending into said bottom surface and generally parallel to said rear wall, said first slot being defined at least partially by said rear wall, said first slot extending through at least one of the side walls.

2. The construction unit of claim 1, wherein said first slot extends through one of said side walls from said hollow core to the exterior of the construction unit.

3. The construction unit of claim 2, further comprising a second hollow core and a second slot extending through the other of said side walls from said second hollow core to the exterior of the construction unit, said second slot also extending through the bottom surface of the construction unit, said rear wall defining at least a portion of said second slot, said second slot adapted to receive flashing.

4. The construction unit of claim 3, wherein said first and second slots are aligned with one another.

5. The construction unit of claim 4, wherein a recess of constant depth extends into said rear wall and all along said rear wall, said recess defining a portion of said first and second slots.

6. The construction unit of claim 4, further comprising a web extending from said front wall to said rear wall, and a third slot extending through said web, said third slot being aligned with said first and second slots.

7. The construction unit of claim 1, wherein said first slot includes a rear surface, a front surface, and a top surface, said rear surface being defined by said rear wall.

8. A construction unit for use with flashing to direct water out of a structure, comprising:
- a front wall, a rear wall, and two side walls;
- a top surface and a bottom surface;
- at least one hollow core extending from said top surface to said bottom surface;
- an opening extending through said front wall from said hollow core to the exterior of the construction unit; and
- a slot adapted to receive flashing, said slot extending into said bottom surface and generally parallel to said rear wall,
- wherein said slot includes a rear surface, a front surface, and a top surface, and said rear wall defines the front surface, the top surface, and the rear surface of said slot.

9. The construction unit of claim 8, wherein said rear wall defines a partition between said slot and said cores.

10. The construction unit of claim 8, wherein said slot extends through said rear wall.

11. The construction unit of claim 1, the construction unit further comprising a second slot extending through the other of said side walls, and a secondary cavity between said core and said rear wall, said first and second slots extending between said secondary cavity and the exterior of said construction unit.

12. The construction unit of claim 11, further comprising an intermediate wall extending between said side walls at a location between said rear wall and said front wall, said intermediate wall defining a partition between said core and said secondary cavity.

13. The construction unit of claim 12, wherein said intermediate wall is connected to said rear wall only by said side walls.

14. The construction unit of claim 1, further comprising a second slot extending through said rear wall, said second slot extending through the bottom surface of the construction unit.

15. The construction unit of claim 14, further comprising a web extending parallel to and equally distanced from said two side walls, said web having opposite sides, and said second slot having a side substantially coplanar with one of said sides of said web.

16. The construction unit of claim 1, further comprising an insect screen positioned in said opening.

17. The construction unit of claim 16, wherein said insect screen is positioned in an insert member having a shape conforming to the wall of the construction unit defining said opening.

18. The construction unit of claim 17, wherein a lip protrudes from said insert member, and a groove is defined in the wall defining said opening, said lip being received in said groove.

19. In combination, a construction unit for receiving flashing and a flashing member, wherein the construction unit comprises:
- a front wall, a rear wall, and two side walls;
- a top surface and a bottom surface;
- at least one hollow core extending from said top surface to said bottom surface;

an opening extending through said front wall from said hollow core to the exterior of the construction unit; and a first slot adapted to receive the flashing member, said first slot extending into said bottom surface and generally parallel to said rear wall, said first slot being defined at least partially by said rear wall, and wherein said flashing member comprises:

a flange extending into said first slot, and a main portion extending from said flange, across said hollow core and beyond said front wall to the exterior of said construction unit.

20. The combination of claim 19, wherein said rear wall defines a portion of said first slot.

21. The combination of claim 19, further comprising an insect screen positioned in said opening.

22. The combination of claim 21, wherein said insect screen is positioned in an insert member having a shape conforming to the wall of the construction unit defining said opening.

23. The combination of claim 22, wherein a lip protrudes from said insert member, and a groove is defined in the wall defining said opening, said lip being received in said groove.

24. A wall comprising a plurality of construction units defining cavities, including a first course of slotted construction units each having:

a front wall, a rear wall, and two side walls;

a top surface and a bottom surface;

at least one hollow core extending from said top surface to said bottom surface;

an opening extending through said front wall from said hollow core to the exterior of the construction unit;

a first slot adapted to receive flashing, said first slot extending into said bottom surface and generally parallel to said rear wall, said first slot being defined at least partially by said rear wall; and a flashing member extending under the course of slotted construction units, said flashing member extending into said first slots of said slotted construction units, said course of slotted units being positioned at a level where disposal of water from said wall is desired.

25. The wall of claim 24, further comprising a second course of said slotted construction units adjacent to said first course and inverted with respect to said first course, said first slots of each of said first and second courses facing toward the other of said first and second courses, said flashing member extending into said first slots of both of said first and second courses of said slotted construction units, whereby said first slots of one of said courses retains said flashing member in position during the laying of the other of said courses.

* * * * *